United States Patent [19]

Cassidy et al.

[11] 4,028,064

[45] June 7, 1977

[54] BERYLLIUM COPPER PLATING PROCESS

[75] Inventors: Stephen Cassidy, Canton, Mass.; Robert Baboian, Johnston; Raymond A. Frechette, Woonsocket, both of R.I.; Gardner S. Haynes, Attleboro, Mass.; John W. Ross, Cumberland, R.I.

[73] Assignee: Texas Instruments Incorporated, Dallas, Tex.

[22] Filed: Feb. 17, 1976

[21] Appl. No.: 658,319

[52] U.S. Cl. ..... 428/675; 428/929; 204/28; 204/32 R; 204/37 R; 204/40; 428/649; 428/673

[51] Int. Cl.[2] ..... C25D 5/12; C25D 5/34; C25D 5/50

[58] Field of Search ..... 204/37 R, 40, 32 R, 204/28; 29/199

[56] References Cited

UNITED STATES PATENTS

| | | | |
|---|---|---|---|
| 3,189,532 | 6/1965 | Chow et al. | 204/28 |
| 3,556,957 | 1/1971 | Toledo et al. | 204/32 R |
| 3,622,474 | 11/1971 | Greenspan | 204/47 |
| 3,920,409 | 11/1975 | Taniguchi | 29/191.6 |
| 3,925,170 | 12/1975 | Skomoroski et al. | 204/43 N |

FOREIGN PATENTS OR APPLICATIONS

| | | | |
|---|---|---|---|
| 2,126,194 | 12/1971 | Germany | 204/40 |

*Primary Examiner*—F.C. Edmundson
*Attorney, Agent, or Firm*—John A. Haug; James P. McAndrews; Harold Levine

[57] ABSTRACT

A process for plating beryllium copper with an excellent electrically conductive material such as gold for use in high reliability applications wherein a heat treating step is employed after forming to yield a desired hardness spring temper comprising the steps of: providing a copper-rich surface on the beryllium copper; electroplating the copper-rich surface with a diffusion barrier preplate; heat treating the beryllium copper material to a desired temper; and electroplating the material with a high electrically conductive material. This process provides for a void-free, durable gold plate which can be produced by a continuous automated strip plating line before and after heat treating.

15 Claims, 1 Drawing Figure

BERYLLIUM COPPER PLATING PROCESS

BACKGROUND AND SUMMARY OF INVENTION

Figure 1:
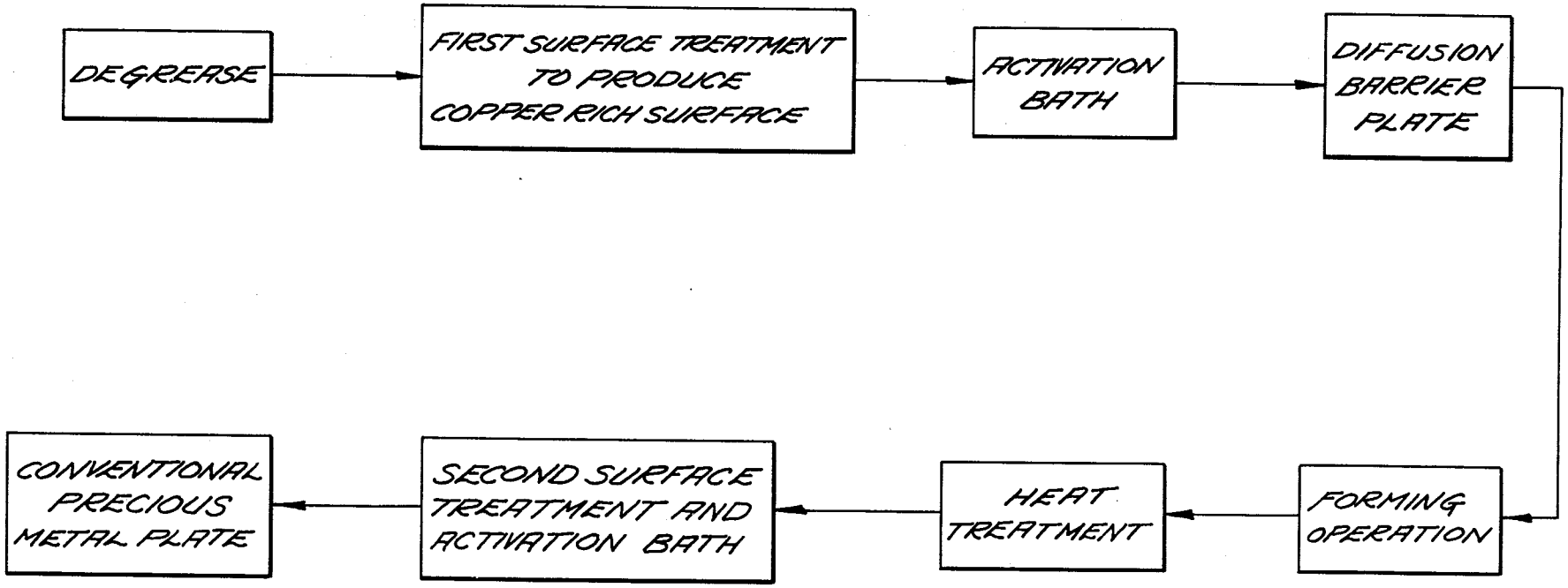

The present invention relates to a plating process for beryllium copper and more particularly to a plating process for beryllium copper wherein a heat treating operation is needed after forming to yield a desired temper and surface quality.

Many applications exist for an electrical contact material with excellent electrical conductivity properties as well as superior spring properties. For many uses it is a further requirement that the material can be gold or other precious metal electroplated for high reliability and long life in operation. Beryllium copper is a material which has both excellent electrical conductivity and spring properties but to achieve the desired spring properties a post forming heat treatment is often necessary. However, during the heat treating of the beryllium copper, diffusion of the beryllium to the surface of the material takes place and the beryllium forms tenacious surface compounds. The abundance of the surface compounds of beryllium make the beryllium copper material very difficult to electroplate uniformly especially if a continuous automated strip plating process is desired. Typically prior art processes, if successful at all, for electroplating beryllium copper after a final heat treatment require too long a time in solution to reasonably provide for a continuous strip plating operation. Prior art processes would also have void areas in the electroplate where all the beryllium compounds were not removed or preferentially removed, or a roughen surface which would therefore make the material unusable for high reliability applications.

Accordingly, an object of the present invention is to provide an improved process for electroplating beryllium copper material.

Another object of the present invention is to provide a process for electroplating beryllium copper material which yields uniform consistent void-free plating even when a post forming heat treatment is required.

Yet another object of the present invention is to provide a process for electroplating a continuous strip of beryllium copper material even when a post forming heat treatment is required which is simple and economical and creates a uniform, void-free plated surface. Other objects and features will be in part apparent and in part pointed out hereinafter.

Briefly, the present invention involves a process particularly suitable for providing a uniform, void-free electroplated layer on the surface of beryllium copper which requires a post forming heat treatment to yield the desired hardness spring property. This process preferably involves treatment and preplating of the beryllium copper before the heat treatment in addition to possible treatment and electroplating after the heat treatment.

After final manufacturing operations are performed, the beryllium copper material is degreased and the surface and the molecular portions immediately adjacent the surface are treated to yield a copper-rich surface skin layer as set forth in co-pending application entitled "Treatment of Beryllium Copper Surface Prior to Electroplating", Ser. No. 658,320, assigned to the assignee of above application. This copper-rich surface is then activated and plated with a thin layer of nickel and then a thin layer of copper. The nickel serves as a diffusion barrier for the beryllium in the beryllium copper material as it diffuses toward the surface during subsequent heat treatment.

After the above processing steps the material is typically formed into parts blanked from the beryllium copper strip and heat treated in a conventional manner to yield the desired spring temper. The combination of the copper-rich surface which is virtually free of any beryllium and the diffusion barrier of nickel prevent the beryllium from diffusing to the surface during the heat treatment thereby providing for void-free plating. The beryllium copper material may then be treated to remove any beryllium compounds that might have formed on the edges of the surface which were exposed during forming. Then the surface of the beryllium copper material is activated for electroplating and then electroplated with preferably a precious metal plate. This process provides for void-free plated beryllium copper material of suitable temper that can be used for high reliability applications such as in electronic telephone switching equipment.

Referring to the drawing:

FIG. 1 is a block diagram illustration of a process for electroplating the beryllium copper.

The present invention is thus directed to a high reliability process for electroplating beryllium copper especially when a post material forming heat treatment is needed to obtain a desired spring temper. As shown in FIG. 1, preferably a continuous beryllium copper strip of material is first passed through a degreasing operation such as a vapor degrease of trichloroethylene vapors at a temperature in the range of 175° F to remove any oil, grease or other organic substances from the surface of the beryllium copper. The beryllium copper may be any of the commercially available grades such as one having 1.8 weight percent beryllium and the balance copper.

The material is secondly run through an anodic alkaline bath, a deionized water rinse, and a concentrated sulfuric acid bath as explained in detail in the above mentioned co-pending application. In these baths the beryllium is removed from the surface to a depth of around 100 angstroms thereby leaving a copper-rich surface skin layer which is virtually free from any beryllium.

The beryllium copper is then preferably rinsed in deionized water and put through a third copper activating bath as is also described in detail in above mentioned co-pending application. The copper activating bath reduces any copper compounds such as oxides of copper from the copper-rich surface to prepare the material for electroplating.

Once again the beryllium copper material is preferably rinsed in deionized water before the fourth preplate operation to provide a diffusion barrier to the beryllium during the heat treatment and to provide an easily platable surface. The preplate operation involves first running the material through a conventional sulfamate nickel bath to provide a nickel strike of preferably 25 microinches. The temperature of the bath is preferably 145° F although a range from 70° F to 160° F can be used and the dwell time in the bath would be in the range from 5 to 300 seconds depending upon the current density used. For example, to provide for a 25 microinch nickel strike a dwell time of approximately 45 seconds with a current density of 30 amperes/foot$^2$ can be used. Next the material is rinsed in deionized water and put through a nickel activation bath. A preferable bath is a 50 percent hydrochloric acid bath at room temperature although other nickel activating baths would be perfectly acceptable. The above described bath can be used at a higher temperature and with a concentration from 10 to 70 percent. The dwell time in the bath is preferably 15 seconds although a range from 5 to 50 seconds is possible. Lastly the material is rinsed again and put through a conventional copper sulfate bath to provide a copper strike of preferably 35 microinches with a dwell time, temperature of bath, and current density comparable to that for the nickel strike. It is to be understood that other diffusion barrier materials such as cobalt can also be used in place of the nickel.

The material processing, after being rinsed in deionized water and dried, has completed the preheat treatment processing which is designed to be performed in a continuous operation. The material is ready for the fifth and sixth steps of the process which are conventional stamping and/or forming of parts on the strip and heat treatment. The heat treatment of the beryllium copper will vary for different applications and spring temper requirements with a typical heat treatment being at 650° F for 2½ hours. During the heat treatment the beryllium in the beryllium copper will try to diffuse toward the surface; however, the combination of providing for a copper-rich surface and the presence of the diffusion barrier of nickel will virtually eliminate beryllium from diffusing to the surface and thereby forming tenacious surface compounds. Only the edges exposed during stamping will contain beryllium compounds on the surface of the material.

Next the part in strip form is preferably run through a seventh step which is a series of baths to dissolve any beryllium compounds that might have formed on the edge areas during heat treatment and to activate the surface for plating. For many applications the material need not require dissolving of the edge beryllium compounds and only a conventional copper surface activation step is needed. However, for many high reliability applications the procedure involving an anodic alkaline bath followed by a deionized water rinse and a cathodic concentrated sulfuric acid bath is needed.

The anodic alkaline bath is preferably an alkali metal hydroxide solution such as potassium hydroxide (KOH) although other alkali metal hydroxide solutions like sodium hydroxide (NAOH) an lithium hydroxide (LiOH) can also be used. The concentration of solution, temperature, current density and dwell time are chosen such that no surface deterioration of the parts occur during this operation. Good results were obtained with concentrated KOH of between 13 and 18 percent although approximate concentrations from 5 to 30 percent can be used. A suitable cathode for use in the solution is one made from a 300 series stainless steel or nickel. The temperature of the solution can be between 130° F and 200° F with a preferred range between 150° F and 190° F. The current density for the anodic electrolysis is preferably above 50 amperes/foot$^2$ with a typical value of 150 amperes/foot$^2$. A typical dwell time in the solution is 30 seconds with a range between 5 and 50 seconds.

The cathodic sulfuric bath preferably has a concentration of 20 percent with a range between 10 and 30 percent. The temperature of the bath may range from 70° F to 175° F with a preferred temperature of 150° F. A suitable anode for the cathodic treatment is a platinum type anode such as a platinum clad columbium anode. The current density in the bath is preferably about 100 amperes/foot$^2$ with an effective range between 50 and 150 amperes/foot$^2$. The dwell time in the bath should be a minimum of 5 seconds with typical dwell time of 15 seconds.

The beryllium copper part in strip form now has a beryllium compound free copper-rich surface and is ready for a conventional precious metal strike for adhesion and a subsequent heavy precious metal deposit. For example a gold strike may be used of acid or neutral PH formulation providing an initial gold thickness of approximately 5 microinches followed by a rinse and a conventional cobalt hardened low PH high purity gold plate. The material is rinsed again and dried. The baths may be operated in the range from 70° F to 170° F with dwell time from 5 to 300 seconds depending upon the current density used. The processing after heat treatment is also designed to provide for a continuous operation.

A second variation to the above process would be to add a nickel plate prior to the final precious metal plate. The presence of the nickel would afford greater corrosion protection for extremely long life applications. After the above said seventh step the parts strip could be run through a conventional nickel sulfamate bath operating in the temperature range from 70° to 160° F. The dwell time in the solution would be approximately 5 to 300 seconds depending on current density used yielding approximately a 100 microinch layer of nickel. Next the strip would be rinsed and put through a nickel activation bath. One preferred bath would be a 50 percent hydrochloric acid bath operated at room temperature although a range to 190° F could be used. The dwell time in solution would be in the range from 5 to 50 seconds with a typical time of 15 seconds. The strip is rinsed again and is then ready for the final precious metal plating step.

Another variation would be to start with strip material in which the parts were already stamped prior to step one of the process. In this process steps five and seven could be eliminated. The forming step five is eliminated because it is already completed and step seven is eliminated because there would be no edge portions exposed to form beryllium compounds after treatment of steps one to four. Only a copper activating bath is needed to prepare the material for precious metal plating.

Accordingly an improved process for electroplating beryllium copper has been described. The process provides for a void-free plated layer even when a post-forming heat treatment is required to obtain a desired temper. The process also allows for an efficient high speed operation which is very cost effective. The dwell time of the various steps of the process are such that a continuous automated strip plating line can be set up both before and after the heat treatment step.

The practice of the invention may be further illustrated by means of the following examples:

EXAMPLE 1

A continuous strip of beryllium copper having 1.8 weight percent beryllium and the balance copper was passed through a vapor degreaser. Next the material was passed through an anodic bath of 30 percent potassium hydroxide with a temperature of 165° F. A cathode of 304 stainless steel was used and a current density of 150 amperes/foot$^2$. The dwell time in the bath was 30 seconds. Then the strip was rinsed in deionized water and passed through a 70 percent sulfuric acid solution with a temperature of about 105° F and a dwell time of about 30 seconds. The material was rinsed again in deionized water and held in a cathodic bath of sulfuric acid with a 20 percent concentration operated at a temperature of about 150° F. An anode of platinum clad columbium was used with a cathodic current density of 100 amperes/foot². The dwell time in the bath was 15 seconds.

The material was rinsed again and passed through a sulfamate nickel bath to provide a nickel strike of approximately 25 microinches. The bath was at room temperature with a dwell time of 30 seconds and a current density of 10 amperes/foot². After rinsing a nickel activation bath of 50 percent hydrochloric acid was used at room temperature with a 15 second dwell time. Then the material was rinsed once again and run through a copper sulfate bath to provide a copper strike of 35 microinches. The dwell time in the bath would be 15 seconds with a current density of 10 amperes/foot² and the temperature would be room temperature. After rinsing again and drying, the strip was blanked and formed into parts still carried on the strip and heat treated at 675° F for 2½ hours.

After the heat treating the continuous strip was again passed through a continuous line. The part in strip form was passed through an anodic bath of 17 percent potassium hydroxide with a temperature of 150° F. A cathode of 304 stainless steel was used and the current density was 150 amperes/foot². The dwell time in the bath was 30 seconds. Then the material was rinsed in deionized water and held in a cathodic bath of sulfuric acid wih a 20 percent concentration operated at a temperature of about 150° F. An anode of platinum clad columbium was used with a cathodic current density of 100 amperes/foot². The dwell time in the bath was 15 seconds. After rinsing again the strip was put through a conventional gold strike bath to provide a 5 microinch plate followed by a water rinse and a cobalt hardened low PH high purity gold plate. The strike bath was operated at 135° F with a dwell time of 15 seconds and a current density of 20 amperes/foot². The gold plate bath was operated at 150° F with a dwell time of 60 seconds and a current density of 70 amperes/foot². The material was water rinsed for a final time and dried. The process yielded a uniform, void-free plated surface.

EXAMPLE 2

Example 1 was repeated except additional steps of providing for a nickel sulfamate bath, a deionized water rinse, a nickel activation bath and another deionized water rinse were added immediately prior to the final gold strike and plate. A conventional nickel sulfamate plating bath was used operated at 90° F with a dwell time in solution of approximately 30 seconds with a current density of 10 amperes/foot². The nickel activation bath was a 50 percent hydrochloric acid bath operated at room temperature with a dwell time of 15 seconds.

EXAMPLE 3

Example 1 was repeated except the anodic bath of 17 percent potassium hydroxide was replaced with an anodic bath of 17 percent sodium hydroxide.

EXAMPLE 4

Example 1 was repeated except the anodic bath of 17 percent potassium hydroxide was omitted.

EXAMPLE 5

Example 2 was repeated with the nickel activation bath of example 2 replaced with cathodic 10 percent sulfuric acid bath operated at 165° F. An anode of platinum clad columbium was used with a cathodic current density of 100 amperes/foot². The dwell time in the bath was 15 seconds.

EXAMPLE 6

Example 1 was repeated except the step using the 70 percent sulfuric solution was omitted and also the subsequent deionized water rinse.

EXAMPLE 7

Example 1 was repeated except the anodic bath of 17 percent potassium hydroxide was replaced with an anodic bath of 17 percent lithium hydroxide.

EXAMPLE 8

A continuous parts strip of beryllium copper having 2 weight percent beryllium and the balance copper was passed through a vapor degreaser. Next the material was passed through an anodic bath of 45 percent potassium hydroxide at the temperature of 180° F. A cathode of 347 stainless steel was used and the current density was 185 amperes/foot². The strip was then rinsed in deionized water and passed through a 55 percent sulfuric acid solution at 170° F and a dwell time of 20 seconds. The strip was rinsed again in deionized water and passed through a bath of sodium cyanide using 8 ounces of sodium cyanide per gallon of deionized water. The temperature of the bath was 90° F and the dwell time is 20 seconds.

The material was rinsed again and passed through a sulfamate nickel bath to provide a nickel strike of approximately 25 microinches. The bath was at room temperature with a dwell time of 15 seconds at a current density of 10 amperes/foot². After rinsing a nickel activation bath of 50 percent hydrochloric acid was used at room temperature with a 15 second dwell time. Then the material was rinsed once again and run through a copper sulfate bath to provide a copper strike of 35 microinches. The dwell time in the bath would be 15 seconds with a current density of 10 amperes/foot² and the temperature would be room temperature. After rinsing and drying the parts strip was heat treated at 650° F for 2 hours.

After heat treating the strip was again passed through a continuous line. The strip was held in a cathodic bath of sulfuric acid with a 25 percent concentration operated at a temperature of about 150° F. An anode of platinum clad columbium was used with a cathodic current density of 100 amperes/foot². The dwell time in the bath was 15 seconds. After rinsing in deionized water the strip was put through a conventional rhodium strike bath to provide a 10 microinch plate followed by a water rinse and a high purity rhodium plate. The strike bath was operated at 140° F with a dwell time of 20 seconds and a current density of 20 amperes/foot². The rhodium plate bath was operated 150° F with a dwell time of 60 seconds and a current density of 75 amperes/foot². The material was rinsed for a final time and dried. The process yields a uniform, void-free plated surface.

EXAMPLE 9

Example 8 was repeated except the cathodic 25 percent bath of sulfuric acid was replaced with a potassium cyanide bath using 8 ounces of potassium cyanide per gallon of deionized water at room temperature and a dwell time of 20 seconds.

EXAMPLE 10

Example 8 was repeated except additional steps of providing for a nickel sulfamate bath, a deionized rinse, a nickel activation bath and another deionized water rinse were added immediately prior to the final rhodium strike and plate. A conventional nickel sulfamate plating bath was used operated at room temperature with a dwell time in solution of approximately 45 seconds with a current density of 10 amperes/foot$^2$. The nickel activation bath was a 50 percent hydrochloric acid bath operated at room temperature with a dwell time of 15 seconds.

EXAMPLE 11

Example 10 was repeated with the nickel activation bath of example 10 replaced with a bath of 3 ounces of nickel cyanide (NiCN) per gallon of water and 6 ounces of potassium cyanide (KCN) per gallon of water followed by a deionized water rinse and a cathodic 10 percent sulfuric acid bath. The (NiCN) and (KCN) bath was operated at room temperature with a dwell time of 10 seconds and 6 volts open circuit. The sulfuric bath was operated at room temperature with a 10 second dwell time and current density of 100 amperes/foot$^2$.

Accordingly all of the above examples produced superior results in which the plated surface was uniform and void-free. Additionally continuous automated strip plating lines were used both before and after the heat treatment operation to provide an efficient, high speed operation.

In view of the above, it will be seen that the several objects of the invention are achieved and other advantageous results attained.

As various changes could be made in the above methods without departing from the scope of the invention, it is intended that all matter contained in the above description shall be interpreted as illustrative and not in a limiting sense. For example for certain applications and with certain precious metal plating materials, the precious metal plating step may be performed directly after the preplate operation and before the heat treatment. Also segmented strips can be processed continuously as described above.

We claim:

1. A process for electroplating beryllium copper material in which a heat treatment after forming is needed to obtain a desired temper comprising the steps of:
   - removing beryllium from the surface layer of a beryllium copper material to provide a copper rich surface skin layer on the beryllium copper material which is virtually free from any beryllium;
   - electroplating the copper-rich surface with a beryllium diffusion barrier plate;
   - heat treating the beryllium copper material to the desired temper; and
   - electroplating the material with a suitable plating material.

2. A process for electroplating beryllium copper material in which a heat treatment after forming is needed to obtain a desired temper comprising the steps of:
   - degreasing the material to remove any organic substances;
   - passing the material through an anodic alkaline solution to form beryllium compounds of the beryllium in the beryllium copper both on the surface and in molecular portions immediately adjacent the surface of the beryllium copper;
   - passing the material through a concentrated sulfuric acid bath to dissolve the formed beryllium compounds thereby providing for a copper-rich skin;
   - activating the surface of the material for electroplating;
   - electroplating the copper-rich surface with a beryllium diffusion barrier plate;
   - heat treating the beryllium copper material to the desired temper;
   - activating the surface of the material for electroplating; and
   - electroplating the material with a suitable plating material.

3. A process for electroplating beryllium copper material as set forth in claim 3 wherein the alkaline solution is a potassium hydroxide solution with a concentration between 10 and 50 percent.

4. A process for electroplating beryllium copper material as set forth in claim 3 wherein the concentration of the sulfuric acid bath is above 20 percent.

5. A process for electroplating beryllium copper material as set forth in claim 3 wherein the diffusion barrier plate is nickel.

6. A process for electroplating beryllium copper parts in which a heat treatment after forming is needed to obtain a desired temper comprising the steps of:
   - degreasing the material to remove any organic substances;
   - passing the material through an anodic potassium hydroxide solution with a concentration between 30 and 40 percent to form beryllium compounds of the beryllium in the beryllium copper both on the surface and in molecular portions immediately adjacent the surface of the beryllium copper;
   - passing the material through a sulfuric acid bath with a concentration greater than 50 percent to dissolve the formed beryllium compounds thereby providing for a copper-rich skin;
   - activating the surface of the material for electroplating;
   - electroplating the copper-rich surface of the material with nickel to provide a beryllium diffusion barrier and then copper to provide an easily platable surface;
   - forming the beryllium copper material into parts;
   - heat treating the beryllium copper material to the desired temper;
   - activating the surface of the material for electroplating; and
   - electroplating the material with a precious metal plate.

7. A process for electroplating beryllium copper parts in which a heat treatment is needed to obtain a desired temper comprising the steps of:
   - degreasing the material to remove any organic substances;
   - passing the material through a first anodic alkaline solution to form beryllium compounds of the beryllium in the beryllium copper both on the surface and in molecular portions immediately adjacent the surface of the beryllium copper;

passing the material through a sulfuric acid bath to dissolve the formed beryllium compounds thereby providing for a copper-rich skin;

activating the surface of the material for electroplating;

electroplating the copper-rich surface with nickel to provide a beryllium diffusion barrier and then copper to provide an easily platable surface;

forming the beryllium copper material into parts;

heat treating the beryllium copper to the desired temper;

passing the material through a second anodic alkaline solution to form beryllium compounds of beryllium exposed during forming on the edges;

passing the material though a cathodic sulfuric acid bath to dissolve the beryllium compounds formed on the edges during forming and to activate the surface for electroplating; and electroplating the material with a precious metal plate.

8. A process for electroplating beryllium copper parts as set forth in claim 7 further comprising a nickel plating step and nickel activating step immediately prior to the precious metal plate to provide further corrosion protection.

9. A process for electroplating beryllium copper parts as set forth in claim 7 wherein the first alkaline solution is potassium hydroxide with a concentration between 10 and 50 percent operated at a temperature between 130° and 200° F and at a current density above 50 amperes/foot$^2$.

10. A process for electroplating beryllium copper parts as set forth in claim 9 wherein the second alkaline solution is potassium hydroxide with a concentration between 5 and 30 percent operated at a temperature between 130° and 200° F and at a current density above 50 amperes/foot$^2$.

11. A process for electroplating beryllium copper parts as set forth in claim 10 wherein the concentration of the sulfuric acid bath is above 20 percent operated at a temperature between 130° and 170° F.

12. A process for electroplating beryllium copper parts as set forth is claim 11 wherein the concentration of the cathodic sulfuric acid bath is between 10 and 30 percent operated at a temperature between 70° and 175° F and at a current density between 50 and 150 amperes/foot$^2$.

13. A strip process for continuous electroplating of beryllium copper strip parts material in which a heat treatment after forming is needed to obtain a desired temper comprising the steps of:

degreasing the strip material to remove any organic substances;

passing the strip material through an anodic potassium hydroxide solution with a concentration between 10 and 50 percent to form beryllium compounds of the beryllium in the beryllium copper both on the surface and in molecular portions immediately adjacent the surface of the beryllium copper;

passing the strip material through a sulfuric acid bath with a concentration greater than 20 percent to dissolve the formed beryllium compounds thereby providing for a copper-rich skin;

activating the surface of the strip material for electroplating;

electroplating the copper-rich surface of the strip material with nickel to provide a beryllium diffusion barrier and then copper to provide an easily platable surface;

forming the beryllium copper strip material into parts in strip form;

heat treating the beryllium copper parts in strip form to the desired temper;

activating the surface of the parts in strip form for electroplating; and electroplating the parts in strip form with a precious metal plate.

14. A strip process for continuous electroplating of beryllium copper strip parts material in which a heat treatment after forming is needed to obtain a desired temper comprising the steps of:

degreasing the strip material to remove any organic substances;

passing the strip material through a first anodic alkaline solution to form beryllium compounds of the beryllium in the beryllium copper both on the surface and in molecular portions immediately adjacent the surface of the beryllium copper;

passing the strip material through a sulfuric acid bath to dissolve the formed beryllium compounds thereby providing for a copper-rich skin;

activating the surface of the strip material for electroplating;

electroplating the copper-rich surface of the strip material with nickel to provide a beryllium diffusion barrier and then copper to provide an easily platable surface;

forming the beryllium copper strip material into parts in strip form;

heat treating the beryllium copper parts in strip form to the desired temper;

passing the parts in strip form through a second anodic alkaline solution to form beryllium compounds of beryllium exposed during forming on the edges;

passing the parts in strip form through a cathodic sulfuric acid bath to dissolve the beryllium compounds formed on the edges during forming and to activate the surface for electroplating; and electroplating the parts in strip form with a precious metal plate.

15. A plated beryllium copper article according to the process as described by claim 2.

* * * * *